US009607552B2

(12) United States Patent
Lim

(10) Patent No.: US 9,607,552 B2
(45) Date of Patent: Mar. 28, 2017

(54) DISPLAY DEVICE AND LUMINANCE CONTROL METHOD THEREFORE

(71) Applicant: LG DISPLAY CO., LTD., Seoul (KR)

(72) Inventor: Kyongho Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 204 days.

(21) Appl. No.: 14/456,526

(22) Filed: Aug. 11, 2014

(65) Prior Publication Data

US 2015/0170560 A1 Jun. 18, 2015

(30) Foreign Application Priority Data

Dec. 17, 2013 (KR) ..... 10-2013-0156922

(51) Int. Cl.
*G09G 5/10* (2006.01)
*G09G 3/3291* (2016.01)

(52) U.S. Cl.
CPC ... *G09G 3/3291* (2013.01); *G09G 2320/0626* (2013.01); *G09G 2330/025* (2013.01); *G09G 2360/16* (2013.01)

(58) Field of Classification Search
CPC ..... G09G 3/3291; G09G 2320/0626; G09G 2330/025; G09G 2360/16
See application file for complete search history.

(56) References Cited

U.S. PATENT DOCUMENTS 7,053,881 B2 * 5/2006 Itoh ..... G09G 3/3406 345/102
8,294,642 B2 * 10/2012 Meguro ..... G09G 3/2081 345/204
8,368,638 B2 * 2/2013 Yun ..... G09G 3/3406 345/102
8,730,275 B2 * 5/2014 Mori ..... G09G 3/20 345/204
8,836,635 B2 * 9/2014 Mori ..... G09G 3/3208 345/102
8,896,641 B2 * 11/2014 Kim ..... G09G 3/3233 345/690
9,093,025 B2 * 7/2015 Lee ..... G09G 3/3233
9,294,748 B2 * 3/2016 Mori ..... G09G 3/20
9,330,594 B2 * 5/2016 Tada ..... G09G 3/30
9,396,684 B2 * 7/2016 Bi ..... G09G 3/3275
2004/0233229 A1 11/2004 Kimura
2004/0257318 A1 12/2004 Itoh
2008/0117153 A1 * 5/2008 Fujine ..... G09G 3/3406 345/89
2009/0153537 A1 * 6/2009 Tada ..... G09G 3/30 345/212

(Continued)

FOREIGN PATENT DOCUMENTS

CN 101351835 A 1/2009
CN 101379546 A 3/2009

(Continued)

*Primary Examiner* — Peter D McLoone
(74) *Attorney, Agent, or Firm* — Dentons US LLP

(57) ABSTRACT

A display device and a luminance control method therefore are provided. The display device comprises a luminance controller that establishes multiple peak luminance control (PLC) points by equally dividing a PLC curve and limits the luminance at the PLC point corresponding to the highest average pixel level (APL) at the initial luminance as the PLC curve slopes downward.

9 Claims, 8 Drawing Sheets

| | Initial luminance | k=1 | k=0.90 | k=0.80 |
|---|---|---|---|---|
| P0 | 255 | 255 | P0'=218 | P0'=184 |
| P1 | 225 | 225 | P1'=218 | P1'=184 |
| P2 | 205 | 205 | P2'=205 | P2'=184 |
| P3 | 185 | 185 | P3'=185 | P3'=184 |
| P4 | 165 | 165 | P4'=165 | P4'=165 |
| P5 | 145 | 145 | P5'=145 | P5'=145 |
| P6 | 120 | 120 | P6'=120 | P6'=120 |
| P7 | 100 | 100 | P7'=100 | P7'=100 |

(56) References Cited

U.S. PATENT DOCUMENTS

| | | | | |
|---|---|---|---|---|
| 2009/0174636 | A1* | 7/2009 | Kohashikawa | G09G 3/3406 345/87 |
| 2010/0127957 | A1* | 5/2010 | Meguro | G09G 3/2081 345/77 |
| 2010/0295877 | A1* | 11/2010 | Yun | G09G 3/3406 345/690 |
| 2011/0205442 | A1* | 8/2011 | Mori | G09G 3/3208 348/673 |
| 2011/0227966 | A1* | 9/2011 | Mori | G09G 3/20 345/690 |
| 2012/0306947 | A1* | 12/2012 | Kim | G09G 3/3233 345/694 |
| 2012/0327141 | A1 | 12/2012 | Yoshida | |
| 2013/0076803 | A1* | 3/2013 | Lee | G09G 3/3233 345/690 |
| 2014/0307170 | A1* | 10/2014 | Mori | G09G 3/20 348/687 |
| 2015/0123955 | A1* | 5/2015 | Bi | G09G 3/3275 345/207 |

FOREIGN PATENT DOCUMENTS

| | | | |
|---|---|---|---|
| EP | 1276097 | A2 | 1/2003 |
| JP | 2004117484 | A | 4/2004 |
| KR | 20130032760 | A | 4/2013 |

* cited by examiner

Peak Luminance

Full white Luminance

| | Initial luminance | k=1 | k=0.90 | k=0.80 |
|---|---|---|---|---|
| P0 | 255 | 255 | 218 | 184 |
| P1 | 225 | 225 | 192 | 162 |
| P2 | 205 | 205 | 175 | 148 |
| P3 | 185 | 185 | 158 | 133 |
| P4 | 165 | 165 | 141 | 119 |
| P5 | 145 | 145 | 124 | 104 |
| P6 | 120 | 120 | 103 | 86 |
| P7 | 100 | 100 | 86 | 72 |

| | Initial luminance | k=1 | k=0.90 | k=0.80 |
|---|---|---|---|---|
| P0 | 255 | 255 | P0'=218 | P0'=184 |
| P1 | 225 | 225 | P1'=218 | P1'=184 |
| P2 | 205 | 205 | P2'=205 | P2'=184 |
| P3 | 185 | 185 | P3'=185 | P3'=184 |
| P4 | 165 | 165 | P4'=165 | P4'=165 |
| P5 | 145 | 145 | P5'=145 | P5'=145 |
| P6 | 120 | 120 | P6'=120 | P6'=120 |
| P7 | 100 | 100 | P7'=100 | P7'=100 |

DISPLAY DEVICE AND LUMINANCE CONTROL METHOD THEREFORE

This application claims the benefit of Korea Patent Application No. 10-2013-0156922 filed on Dec. 17, 2013, which is incorporated herein by reference for all purposes as if fully set forth herein.

BACKGROUND OF THE INVENTION

Field of the Invention

The present invention relates to a display device and a luminance control method therefore.

Discussion of the Related Art

Flat panel displays include a liquid crystal display device (LCD), a plasma display panel (PDP), an organic light emitting diode display (hereinafter, referred to as 'OLED display'), an electrophoretic display device (EPD), etc. A liquid crystal display displays an image by controlling an electric field applied to liquid crystal molecules according to data voltages. An active matrix liquid crystal display has advantages of reduced prices and performance improvement with the development of the processing technology and the driving technology. Thus, the active matrix liquid crystal display is the most widely used display device applied to almost any display device, from small mobile device to large televisions.

Because the OLED display is a self-emitting device, it has lower power consumption and a thinner profile than a liquid crystal display requiring a backlight unit. Further, the organic light emitting display has advantages of wide viewing angle and fast response time. The OLED display is gaining market share while competing with liquid crystal displays.

Each pixel of the OLED display comprises an organic light emitting diode (hereinafter, referred to as 'OLED'), which is a self-luminous element. As shown in FIG. 1, the OLED includes organic compound layers such as a hole injection layer HIL, a hole transport layer HTL, an emission layer EML, an electron transport layer HTL, and an electron injection layer EIL, which are stacked between an anode and a cathode. The OLED display reproduces an input image as the OLED of each pixel emits light when electrons and holes are combined in an organic layer by allowing current to flow through a fluorescent or phosphorescent organic thin film.

The OLED display may be classified into different types based upon the type of luminescence material, the emission scheme, the emission structure, the driving scheme, etc. The OLED display may be divided into fluorescent emission type and phosphorescent emission type according to the emission scheme, or divided into top emission type and bottom emission type according to the emission structure. Also, the OLED display may be divided into PMOLED (Passive Matrix OLED) and AMOLED (Active Matrix OLED) according to the driving scheme.

In order to efficiently reduce the power consumption of a display device, it is necessary to lower the luminance of the screen, which greatly affects electricity consumption. However, simply reducing luminance can reduce power consumption, but may result in picture quality degradation. For example, if the user decreases the luminance of display images, the luminance of a bright image with a high average picture level (hereinafter, 'APL') may become excessively low. The APL is defined as the average luminance of the brightest color in 1-frame image data and expressed by Equation (1):

$$APL(\%) = \frac{\text{SUM}\{\text{Max}(R, G, B)/255\}}{\text{The total number of pixels}} \times 100 \qquad \text{Equation (1)}$$

where R is represents red data, G represents green data, and B represents blue data. Max(R,G,B) is the maximum values of R, G and B, and SUM {Max(R,G,B)} is the sum of the maximum values of R, G and B.

An image containing a large amount of bright pixel data has a high APL. On the other hand, an image containing a small amount of bright pixel data has a low APL. The peak white gray level of 8-bit pixel data is gray value 255.

As shown in FIG. 2, if approximately 25% of the pixels on the entire screen have the peak white gray level and the remaining pixels have the black gray level 0 (zero), the APL is 25%. On the contrary, if the pixels on the entire screen have the peak white gray level 255, the APL is 100%. Hereinbelow, the luminance at the APL of 25% is referred to as peak luminance, and the luminance at the APL of 100% is referred to as full white luminance.

Peak luminance is higher than full white luminance because it causes less load on the screen. In the OLED display, more current flows through the OLEDs of the pixels at peak luminance and they emit brighter light than at full white luminance. Peak luminance control (hereinafter, 'PLC') is a method of reducing power consumption by decreasing luminance with increasing APL, based on the PLC curve shown in FIG. 3. The PLC curve defines the maximum luminance of pixels. The pixels of a display panel emit light at a level equal to or below the maximum luminance defined by the PLC curve. On the PLC curve of FIG. 3, luminance versus APL is defined in such a way that the maximum luminance of the pixels increases with decreasing APL and decrease with increasing APL.

The PLC curve of FIG. 3 is expressed by Equation (2). The PLC curve can be equally divided by 8 PLC points. When the user adjusts luminance through a user interface (UI), k in Equation (2) is adjusted in proportion to the amount of luminance adjustment by the user and the luminance at the PLC points at all APLs is adjusted by a fixed percentage.

$$Pi = Pi \times k \qquad \text{Equation (2)}$$

where i=0, 1, 2, 3, 4, 5, 6, and 7.

k is a luminance adjustment variable. k=1.00~0.

P0 is the peak luminance, and Pi is the luminance at the i-th PLC point which is lower than the peak luminance.

The related art PLC is problematic in that the full white luminance and the contrast ratio become excessively low if the user decreases the luminance of a display device. FIG. 4 shows the luminance variations on the PLC curve when the luminance of an OLED display decreases to 90% (k=0.9), 80% (k=0.8), 65% (k=0.65), 30% (k=0.3), and 20% (k=0.2).

Referring to FIG. 4, the figures in the table are digital values for determining luminance. The higher the digital values, the higher the luminance of the pixels. The digital values may be transmitted to the timing controller of the display device through I2C communication. The following description will be given under the assumption that the digital values are luminance values.

The initial luminance at the PLC points may be set to P0=255, P1=225, P2=205, P3=185, P4=165, P5=145, P6=120, and P7=100.

When the user decreases the luminance of the OLED display to 90% (k=0.90), the luminance at the PLC points decreases to P=218, P1=192, P2=175, P3=158, P4=141, P5=124, P6=103, and P7=86 according to Equation (2). This means that the luminance of the OLED display decreases to 90% of the initial values at all APLs.

When the user decreases the luminance of the OLED display to 80% (k=0.80), the luminance at the PLC points decreases to P=184, P1=162, P2=148, P3=133, P4=119, P5=104, P6=86, and P7=72 according to Equation (2). This means that the luminance of the OLED display decreases to 80% of the initial values at all APLs.

According to the related PLC, when the user decreases the luminance of a display device, the luminance decreases by a fixed percentage at every APL. Thus, the full white luminance becomes excessively low, as indicated by the dotted circle in the graph of FIG. 4. Because most of the pixels on the screen are turned on, a significant decrease in full white luminance and a sharp decline in contrast ratio are observed. Accordingly, PLC control requires a solution to avoid excessive decreases in full white luminance.

SUMMARY OF THE INVENTION

An aspect of this document is to provide a display device which can achieve improvements in full white luminance and contrast ratio through peak luminance control and a luminance control method therefor.

An exemplary embodiment of the present invention provides a display device comprising a luminance controller that establishes multiple PLC points by equally dividing a PLC curve and limits the luminance at the PLC point corresponding to the highest APL at the initial luminance as the PLC curve slopes downward.

The luminance controller controls the luminance at the PLC points according to the following Equation:

$$P'O=PO\times k$$

$$\text{If } Pi \geq P'O \text{ then } P'i=P'O$$

$$\text{others } P'i=Pi \qquad \text{Equation (2)}$$

where i=0, 1, 2, 3, 4, 5, 6, and 7, k=1.00~0,

P0 is the initial peak luminance, P'0 is adjusted peak luminance, Pi is the initial luminance at the i-th PLC point which is lower than the peak luminance, and P'i is the adjusted luminance at the i-th PLC point.

Another exemplary embodiment of the present invention provides a luminance control method for a display device, the method comprising: forming a PLC curve that defines the maximum luminance of pixels according to the APL of an input image; establishing multiple PLC points by equally dividing a PLC curve; and limiting the luminance at the PLC point corresponding to the highest APL at the initial luminance as the PLC curve slopes downward.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1:
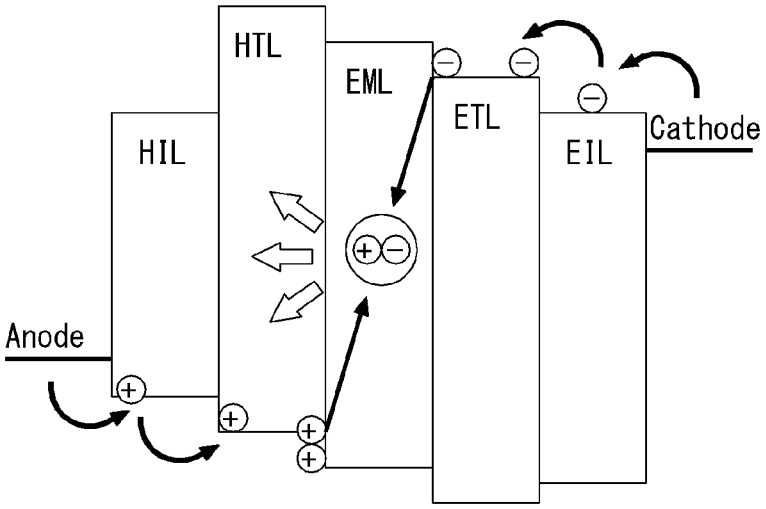
FIG. 1 (RELATED ART)
FIG. 1 is a view showing an OLED structure and the principle of light emission thereof.
Figure 2:
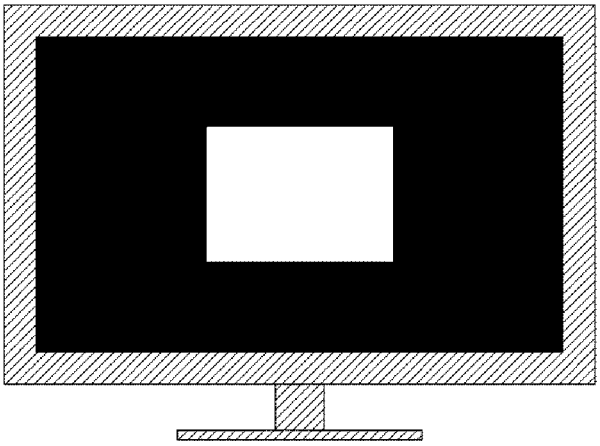
FIG. 2 (RELATED ART)
FIG. 2 is a view showing pixels emitting light at peak luminance and pixels emitting light at full white luminance.
Figure 2:
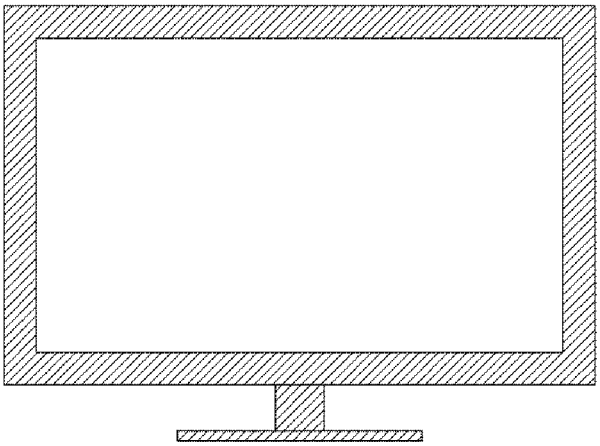
FIG. 2 (RELATED ART)
Figure 3:
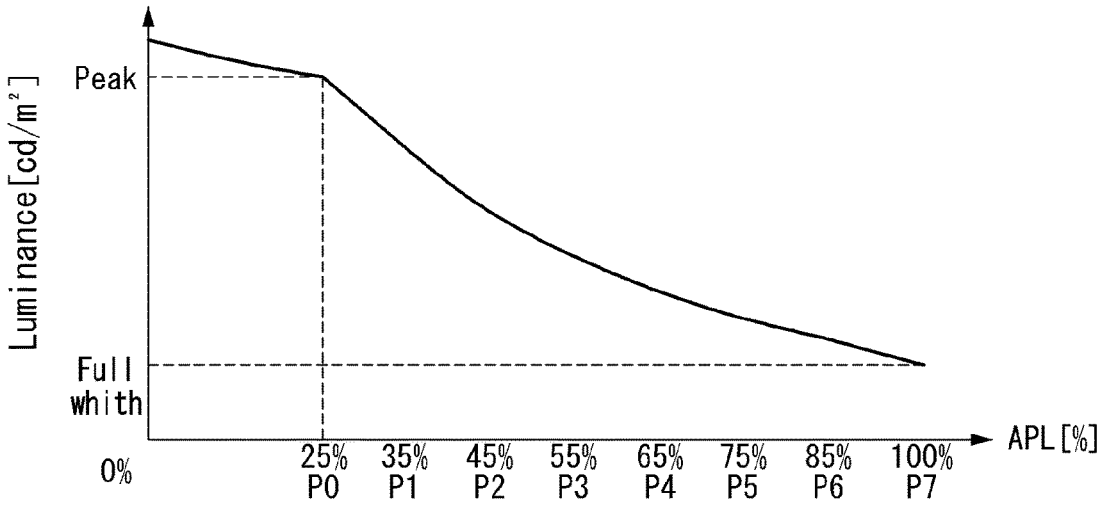
FIG. 3 (RELATED ART)
FIG. 3 is a graph showing a PLC curve used in peak luminance control.
Figure 4:
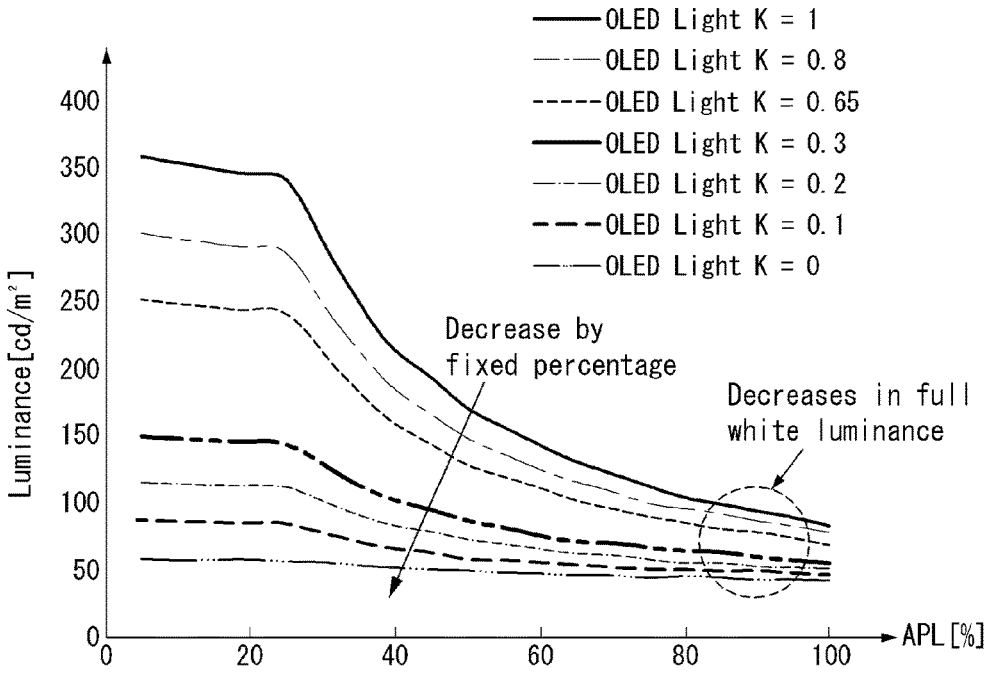
FIG. 4 (RELATED ART)
FIG. 4 is a view showing an example of a decrease in full white luminance observed in peak luminance control.

Hereinafter, exemplary embodiments of the present invention will be described in detail with reference to the attached drawings. Throughout the specification, like reference numerals denote substantially like components. Hereinafter, the detailed description of related known functions or configurations that may unnecessarily obscure the subject matter of the present invention in describing the present invention will be omitted.

In the following embodiment, a display device according to the present invention will be described focusing on, but not limited to, an OLED display. For example, the present invention is also applicable to PDPs.

In a luminance control method according to the present invention, the luminance (P0, P1, . . . P6, P7) of 8 PLC points by which a PLC curve is divided into 8 is adjusted according to Equation (3). The number of divisions of the PLC curve and the number of PLC points are not limited to 8. For example, the PLC curve may be divided into N segments by N PLC points (N is a positive integer equal to or greater than 2). When the user adjusts the luminance of the display device through a user interface (UI), k in Equation (3) is adjusted in proportion to the amount of luminance adjustment by the user and as a result the luminance at the PLC points is adjusted.

$$P'O=PO\times k$$

$$\text{If } Pi \geq P'O \text{ then } P'i=P'O$$

$$\text{others } P'i=Pi— \qquad \text{Equation (3)}$$

where i=0, 1, 2, 3, 4, 5, 6, and 7, k=1.00~0,

P0 is the initial peak luminance, and P'0 is adjusted peak luminance. P0 is adjusted to a lower value when the user decreases the luminance of the display device. Pi is the initial luminance at the i-th PLC point which is lower than the peak luminance. P'i is the adjusted luminance at the i-th PLC point.

Figure 5:
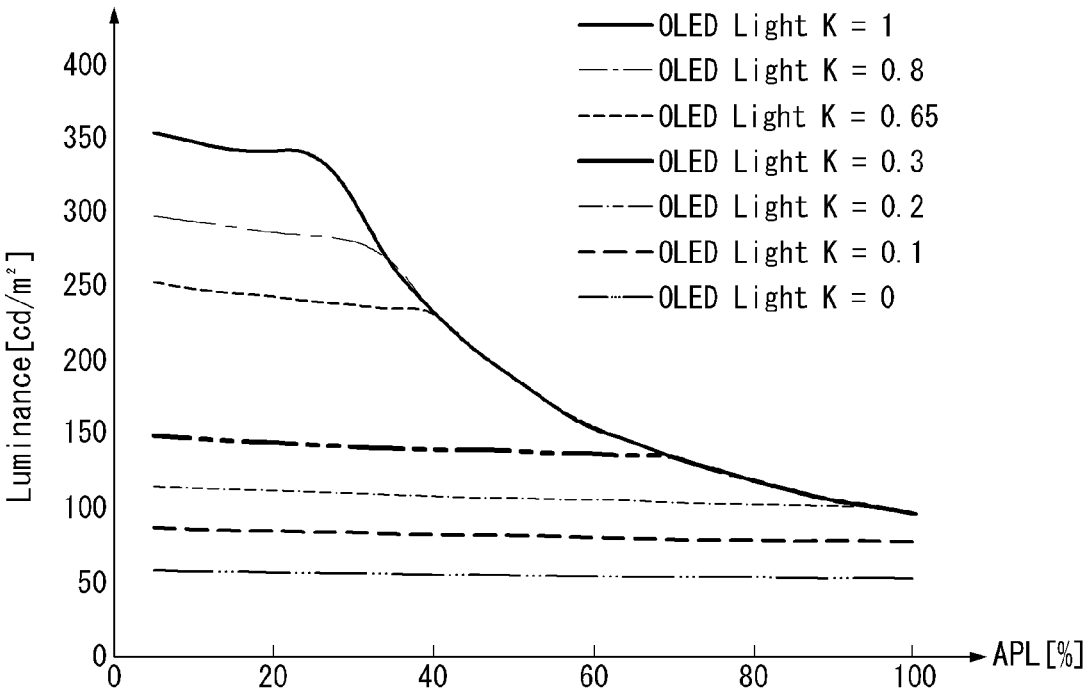
FIG. 5 is a view showing a luminance control method for a display device according to an exemplary embodiment of the present invention.

In the luminance control method of the present invention, when the user decreases the luminance of the display device through a user interface (UI), excessive decreases in full white luminance can be avoided by limiting luminance in an APL section extending from peak luminance to a critical PLC point at the peak luminance level (P0×k) and gradually decreasing the luminance in an APL section after the critical PLC point, rather than adjusting luminance from peak luminance to full white luminance in the entire APL section. The APL section extending from peak luminance to the critical PLC point may comprise two or more PLC points, as shown in FIG. 5. The critical PLC point is the PLC point with the lowest APL in the APL section where Pi<P'0 is satisfied. As in Equation (3), if Pi is equal to or greater than P'0, P'i equals P'0, whereas, if Pi is less P'0, P'i equals Pi.

FIG. 5 is a view illustrating a luminance control method of the present invention when the user decreases the luminance of the OLED display to 90% (k=0.9), 80% (k=0.8), 65% (k=0.65), 30% (k=0.3), and 20% (k=0.2).

Referring to FIG. 5, the initial luminance at the PLC points may be set to P0=255, P1=225, P2=205, P3=185, P4=165, P5=145, P6=120, and P7=100.

When the user decreases the luminance of the OLED display to 90% (k=0.90), the luminance at the PLC points decreases to P'0=P0×0.9=218, P'1=P'0=218, P'2=P2=205, P'3=P3=185, P'4=P4=165, P'5=P5=145, P'6=P6=120, and P'7=P7=86 according to Equation (3). P'1 equals P'0=218 because Pi>P'0, and P'2~P'7 gradually decrease to P2~P7 because Pi<P'0.

When the user decreases the luminance of the OLED display to 80% (k=0.80), the luminance at the PLC points decreases to P'0=P0×0.8=184, P'1=P'0=184, P'2=P'0=184, P'3=P'0=184, P'4=P4=165, P'5=P5=145, P'6=P6=120, and P'7=P7=100 according to Equation (3). P'1~P'3 equal to P'0=184 because Pi>P'0, and P'4~P'7 gradually decrease to P4~P7 because Pi<P'0.

Accordingly, in the luminance control method of the present invention, when the user decreases the luminance of the display device, excessive decreases in full white luminance can be avoided by limiting the luminance at the PLC point corresponding to the highest APL at the initial luminance. As a result, the display device of the present invention can avoid decreases in full white luminance and improve full white luminance and contrast ratio.

The OLED display of the present invention allows decreasing the luminance of the pixels according to APL based on a PLC curve. The luminance on the PLC curve decreases as shown in FIG. 5 when the user decreases the luminance of the OLED display. The OLED display of the present invention allows controlling the maximum luminance of the pixels based on a downward-sloping PLC curve shown in FIG. 5 according to Equation (3).

In the luminance control method of the present invention, a high-potential pixel power voltage VDD can be adjusted in proportion to the luminance on a PLC curve, or a gamma compensation voltage can be adjusted in proportion to the luminance on a PLC curve, or the gray level of input image data can be adjusted in proportion to the luminance on a PLC curve. Also, the luminance of the pixels can be adjusted by using two or more of the above-mentioned methods in combination.

Figure 6:
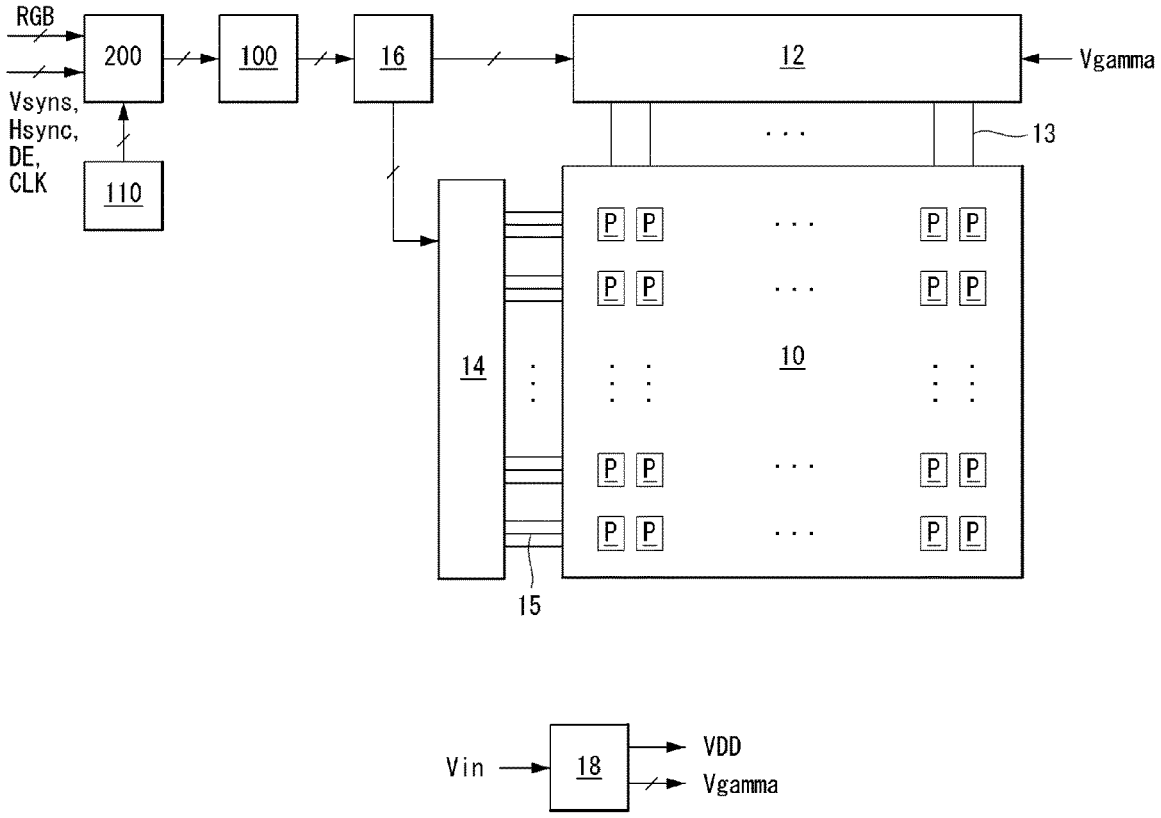
FIG. 6 is a block diagram showing a display device according to an exemplary embodiment of the present invention.
Figure 7:
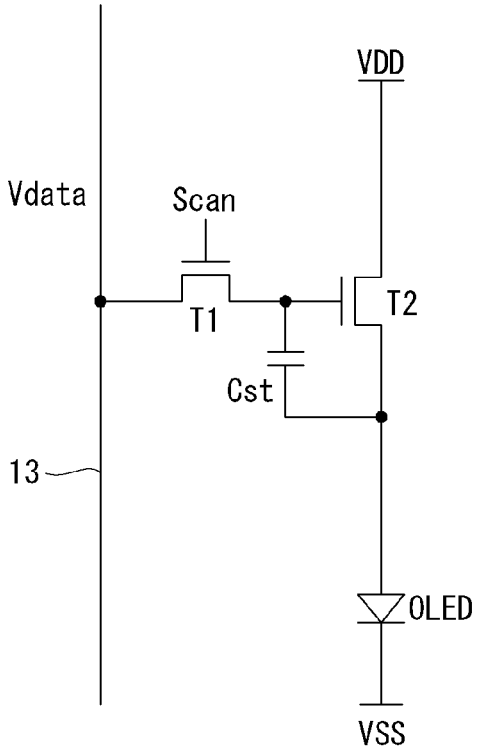
FIG. 7 is an equivalent circuit diagram of the pixels of FIG. 6.

FIGS. 6 and 7 are views showing a display device according to an exemplary embodiment of the present invention.

Referring to FIGS. 6 and 7, the display device according to the present invention comprises a display panel 10, a display panel driver, a timing controller (TCON) 16, a luminance controller 100, and a power source 18.

A plurality of data lines 13 and a plurality of scan lines (or gate lines) 15 cross each other in a pixel array of the display panel 10. The pixel array of the display panel 10 comprises pixels P that are arranged in a matrix form and display an input image. As shown in FIG. 7, each of the pixels P comprises an OLED, a switching element T1, a driving element T2, and a storage capacitor Cst. The switching element T1 and the driving element T2 may be implemented as TFTs (thin film transistors). As shown in FIG. 1, the OLED may comprise a stack of organic compound layers such as a hole injection layer HIL, a hole transport layer HTL, an emission layer EML, an electron transport layer ETL, and an electron injection layer EIL. The switching element T1 applies a data voltage received through the data lines 14 to the gate of the driving element T2 in response to a scan pulse from the scan lines 15. The gate of the switching element T1 is connected to the scan lines 15. The drain of the switching element T1 is connected to the data lines 14, and the source of the switching element T1 is connected to the gate of the driving element T2. The driving element T2 adjusts the current flowing through the OLED depending on the gate voltage. A high-potential pixel power voltage VDD for driving the pixel is applied to the drain of the driving element T2. The source of the driving element T2 is connected to the anode of the OLED. The storage capacitor Cst is connected between the gate and source of the driving element T2. The anode of the OLED is connected to the source of the driving element T2, and the cathode of the OLED is connected to a low-potential power voltage VSS. Each of the pixels P may further comprise a sensing circuit for sensing variations in the characteristics of an internal compensation circuit or driving element (not shown). The internal compensation circuit is a circuit for compensating for variations in the threshold voltage and mobility of the driving element T2.

The display panel driver comprises a data driver 12 and a scan driver 13. The display panel driver writes pixel data received from the timing controller 15 to the display panel 10 to reproduce an input image on the display panel 10.

The data driver 12 converts pixel data of an input image received from the timing controller 16 into an analog gamma compensation voltage Vgamma to generate a data voltage, and outputs the data voltage to the data lines 13. The pixel data input into the data driver 12 is digital video data of an input image.

The scan driver 14 supplies scan pulses (or gate pulses) synchronized with the output voltage of the data driver 12 to the scan lines 15 under the control of the timing controller 16. The scan driver 14 sequentially shifts the scan pulses to sequentially select pixels, line by line, to which data is written.

The luminance controller 100 calculates APL for each frame of an input image. The luminance controller 100 adjusts the luminance at the PLC points as shown in FIG. 5, in order to adjust the PLC curve based on user data received through a user interface (UI) 110. The luminance controller 100 transmits PLC curve data containing PLC points and varying with user data to the timing controller 16. The PLC curve data may be transmitted as 8-bit data to the timing controller 16 through I2C communication. The PLC curve data output from the luminance controller 100 may be transmitted to the timing controller 16 during a vertical blank period of every frame. The vertical blank period is a period of time between an N-th frame (N is a positive integer) and an (N+1)th frame when no data is being drawn. The luminance controller 100 may be embedded in the timing controller 16 or a host system 200.

The timing controller 16 receives input image pixel data, PLC curve data, and timing signals. The timing controller 16 transmits input image pixel data or modulated pixel data DATA' to the data driver 12, and controls the operation timings of the data driver 12 and scan driver 13 based on the timing signals. The timing signals comprise a vertical synchronization signal Vsync, a horizontal synchronization signal Hsync, a clock signal CLK, and a data enable signal DE.

The timing controller 16 may modulate the gray level of input image pixel data based on the PLC curve by using a data modulator 20, or adjust the high-potential pixel power voltage VDD or the gamma compensation voltage Vgamma based on the PLC curve by controlling the power source 18. The data modulator 20 may be implemented as a look-up table LUT. The look-up table modulates pixel data to a gray level that is proportional to the luminance on the PLC curve by receiving PLC curve data and outputting data that is set to be proportional to the luminance on the PLC curve. The timing controller 16 is able to generate PLC control data as a digital value that is proportional to the luminance on the PLC curve and control the output of the power source 18 based on the PLC control data.

The power source 18 receives DC input power Vin from the host system 200 and generates a high-potential pixel power voltage VDD and a gamma compensation voltage Vgamma. The power source 18 adjusts the high-potential pixel power voltage VDD and the gamma compensation voltage Vgamma under the control of the timing controller 16. The high-potential pixel power voltage VDD and the gamma compensation voltage Vgamma are proportional to the luminance on the PLC curve. For example, the high-potential pixel power voltage VDD and the gamma compensation voltage Vgamma become lower as the luminance on the PLC curve decreases.

Figure 8:
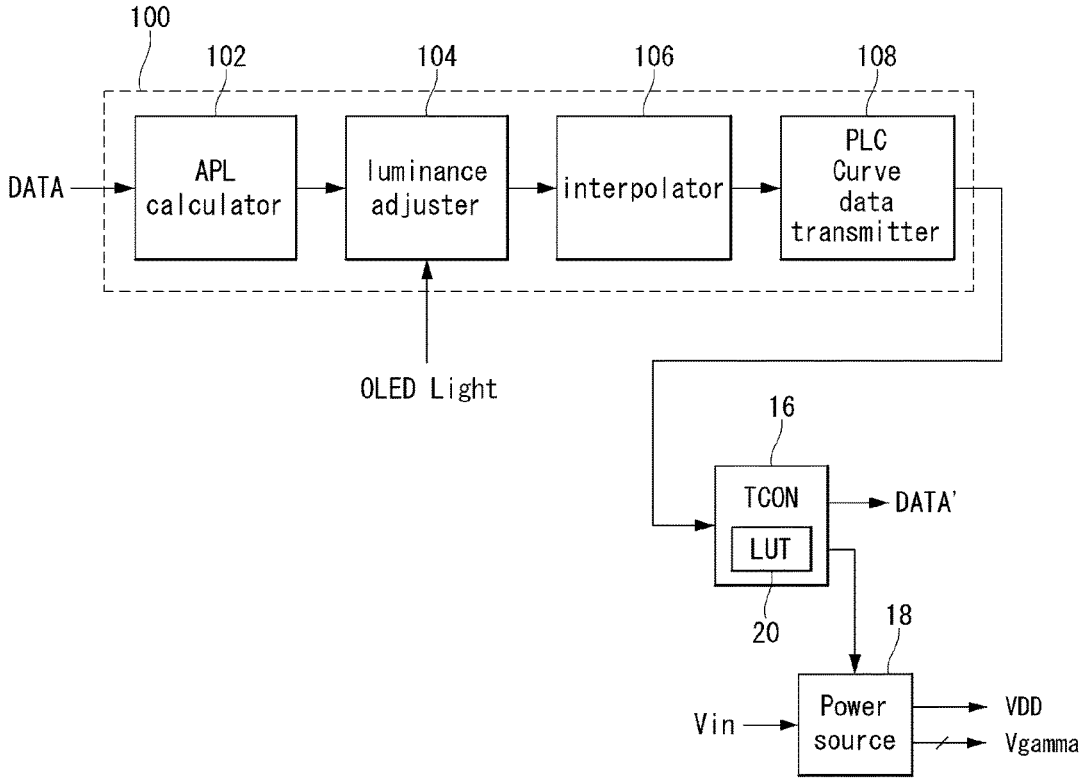
FIG. 8 is a block diagram showing in detail the luminance controller of FIG. 6.

The host system 200 may be implemented as any one of the following: a television system, a set-top box, a navigation system, a DVD player, a Blu-ray player, a personal computer (PC), a home theater system, and a phone system. The host system 200 transmits user data received through the user interface 110 to the luminance controller 100. In FIGS. 5 and 8, "OLED light" is user data.

The user interface 110 may be implemented as a keypad, a keyboard, a mouse, an on-screen display (OSD), a remote controller having an infrared communication function or a radio frequency (RF) communication function, a touch UI, a voice recognition UI, a 3D UI, etc.

FIG. 8 is a view illustrating in detail the luminance controller 100.

Referring to FIG. 8, the luminance controller 100 comprises an APL calculator 102, a luminance adjuster 104, an interpolator 106, and a PLC curve data transmitter 108.

The APL calculator 102 calculates APL for each frame of an input image. The APL calculator 102 is able to receive initial luminance data on the PLC curve from the timing controller 16 and supply it to the luminance adjuster 104, together with the APL of the input image. This is because there may be variations in the luminance, current, and driving characteristics of the display panel 10. A memory connected to the timing controller 16 may store the initial luminance data of the PLC curve which reflect the variations in the characteristics of the display panel 10.

The APL calculator 102 may transmit the initial luminance data on the PLC curve stored in an internal memory to the luminance adjuster 104, without receiving PLC curve data from the timing controller 16.

The initial luminance data on the PLC curve transmitted to the luminance adjuster 104 may contain only the initial luminance values at N PLC points by which the PLC curve is equally divided into N, as described above, in order to reduce the amount of data calculation.

The luminance adjuster 104 adjusts the luminance at each selected PLC point based on user data (OLED light) received through the user interface 110 according to Equation (3). The interpolator 106 calculates the luminance in an APL section between PLC points by linear interpolation. As a result, the interpolator 106 outputs the entire PLC curve data that contains data on the PLC curve joining neighboring PLC points.

The PLC curve data transmitter 108 transmits the PLC curve data received from the interpolator 106 to the timing controller 16.

As described above, the present invention allows the full white luminance of the display device to be limited at the initial luminance when the user decreases the luminance of the display device. As a result, the display device can achieve improvements in full white luminance and contrast ratio.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device in which a peak luminance control (PLC) curve defines a maximum luminance of pixels according to an average pixel level (APL) of an input image the display device comprising:

a luminance controller that establishes multiple PLC points by equally dividing a PLC curve and, when the PLC curve is adjusted by a luminance adjustment variable, limits the luminance of the pixels in a first APL section extending from a lowest PLC point to a predetermined PLC point at an adjusted peak luminance for the lowest PLC point of the PLC curve adjusted by the luminance adjustment variable, and limits the luminance of the pixels in a second APL section after the predetermined PLC point at an initial luminance of the PLC curve which is not adjusted by the luminance adjustment variable, wherein, when a luminance of the display device decreases, the luminance controller adjusts the PLC curve such that the first APL section increases and the second APL section decreases.

2. The display device of claim 1, wherein the luminance controller controls the luminance at the PLC points according to the following Equation:

$$P'O=PO\times k$$

If Pi>P'O then P'i=P'O others P'i=Pi where P0 is an initial peak luminance, P'0 is an adjusted peak luminance, i=0, 1, 2, 3, 4, 5, 6, and 7, and k is the luminance adjustment variable which is ranged within 0 to 1.00, wherein Pi is the initial luminance at the i-th PLC point in the PLC curve, and P'i is an adjusted luminance at the i-th PLC point in the adjusted PLC curve.

3. The display device of claim 2, wherein the predetermined PLC point is a PLC point with the a lowest APL in an APL section where Pi <P'0 is satisfied.

4. The display device of claim 3, wherein two or more PLC points exist in the first APL section.

5. The display device of claim 4, comprising:

a data driver that converts pixel data into a gamma compensation voltage to generate a data voltage, and outputs the data voltage to data lines;

a scan driver that supplies scan pulses synchronized with the data voltage to scan lines; and a timing controller that transmits the pixel data to the data driver and controls the operation timings of the data driver and scan driver, wherein the timing controller modulates the gray level of the pixel data based on the PLC curve or adjusts an high-potential pixel power voltage of the pixels or the gamma compensation voltage based on the PLC curve.

6. The display device of claim 5, wherein the display device is an OLED display or a plasma display panel.

7. A luminance control method for a display device, the method comprising:

forming a peak luminance control (PLC) curve that defines a maximum luminance of pixels according to an average pixel level (APL) of an input image;

establishing multiple PLC points by equally dividing the PLC curve; and when the PLC curve is adjusted by a luminance adjustment variable, limiting the luminance of the pixels in a first APL section extending from a lowest PLC point to a predetermined PLC point at an adjusted peak luminance for the lowest PLC point of the PLC curve adjusted by the luminance adjustment variable, and limiting the luminance of the pixels in a second APL section after the predetermined PLC point at an initial luminance of the PLC curve which is not adjusted by the luminance adjustment variable, wherein, when a luminance of the display device decreases, the luminance controller adjusts the PLC curve such that the first APL section increases and the second APL section decreases.

8. The method of claim 7, wherein the luminance at the PLC points is controlled according to the following Equation:

$$P'O=PO\times k$$

$$\text{If } Pi>P'O \text{ then } P'i=P'O$$

$$\text{others } P'i=Pi$$

where P0 is an initial peak luminance, P'0 is an adjusted peak luminance, i =0, 1, 2, 3, 4, 5, 6, and 7, and k is the luminance adjustment variable which is ranged within 0 to 1.00, wherein Pi is the initial luminance at the i-th PLC point in the PLC curve, and P'i is an adjusted luminance at the i-th PLC point in the adjusted PLC curve.

9. The method of claim 8, comprising:

supplying a high-potential pixel power voltage to the pixels;

converting pixel data into a gamma compensation voltage to generate a data voltage, and outputting the data voltage to data lines;

modulating the gray level of the pixel data based on the PLC curve or adjusting the high-potential pixel power voltage or the gamma compensation voltage based on the PLC curve.

* * * * *